United States Patent [19]

Shannon

[11] Patent Number: 4,723,794

[45] Date of Patent: Feb. 9, 1988

[54] GUEST CHECK

[75] Inventor: Joseph W. Shannon, Kent, Ohio

[73] Assignee: American Business Computers, Akron, Ohio

[21] Appl. No.: 829,078

[22] Filed: Feb. 13, 1986

[51] Int. Cl.[4] ..... B42D 15/02; B42D 15/04

[52] U.S. Cl. ..... 283/60 A; 283/60 R; 282/11.5 A

[58] Field of Search ..... 283/60 R, 60 A, 1 R, 283/105; 282/11.5 A

[56] References Cited

U.S. PATENT DOCUMENTS

| | | | |
|---|---|---|---|
| 719,209 | 1/1903 | Geller | 283/60 R |
| 972,549 | 10/1910 | Lewis | 283/60.1 |
| 1,330,730 | 2/1920 | Thompson | 283/60 A |
| 1,543,414 | 6/1925 | Asaturian | 283/60 R |
| 1,551,660 | 9/1925 | Gove | 283/1 R |
| 2,507,307 | 5/1950 | Josephy | 283/60 R |
| 3,837,565 | 9/1974 | Johnsen | 282/11.5 A X |
| 4,615,929 | 10/1986 | Alexander, Jr. | 283/105 X |

*Primary Examiner*—P. W. Echols
*Assistant Examiner*—Taylor J. Ross
*Attorney, Agent, or Firm*—Oldham, Oldham & Weber Co.

[57] ABSTRACT

Restaurant guest check or the like, comprising perforations which divide the check into at least three (3) portions. The first portion is for listing items purchased in a first category, such as food, the second portion is for listing items purchased in a second category, such as alcoholic beverages, and the third and smallest portion is for indicating the total price of all items purchased. Also disclosed is a tractor feed sheet comprising tractor feed strips along either side and a plurality of transversely extending weakened portions which divide the sheet into individual blank checks as above described. A patron's printed guest check is generated by computer. Food items are printed in the first portion, alcoholic beverage items in the second portion and the total price in the third portion.

17 Claims, 4 Drawing Figures

GUEST CHECK

TECHNICAL FIELD

This invention relates to printed receipts or checks for purchases and more particularly to guest checks.

BACKGROUND ART

Restaurant guest checks are often hand written and totalled. In a typical arrangement, food purchases are recorded on the face of the check, liquor purchases on the back and the total amounts of food and liquor are added up and a grand total indicated near the bottom of the face of the check. In some cases both food and liquor purchases are recorded in the same area on the face of the check. Some restaurant checks are partially printed. Such checks may include, for example, a printed itemization of food purchases on the face of the check and a hand written record of liquor purchases on the back of the check. Typically the total of food purchases and a total of liquor purchases are added by hand on the face of the check.

Itemized printed hotel bills listing all charges are known. Such bills are invariably organized on a day-by-day basis, listing all charges, e.g. room, restaurant, telephone and tax for each day, with a grand total printed at the bottom of the itemized listing. All charges are listed in a single area, and there is no subtotal of charges of a particular type (telephone charges for example). Computer-generated supermarket cash register receipts are also known. These list all items in random order (i.e. in the order in which the items are checked out), listing the category of each (e.g., produce, meats, paper goods). Such receipts give the sub-total of taxable items and the sales tax due, as well as the total price of all items purchased.

Restaurant guest checks in which both food and alcoholic beverage purchases are computer printed are also known but not in widespread use. Each item is listed on a separate line. Typically all items in one category (say Food) are listed first, followed by all items in another category (say liquor). All purchases, both food and liquor, are listed in a single section. Such a check typically has no detachable portions other than a customer's receipt, which is optional, at the bottom.

Whether a restaurant check is entirely hand written or partially or entirely printed, it is invariably presented on an individual sheet of paper which, in the case of the partially printed check, must be individually loaded into the cash register for printing. This piece of paper is usually devoid of any perforations, although in some cases there is a tearoff stub, which serves as a customer receipt, at the bottom of the paper. The total bill is hand written on this stub. More often than not, the check consists of a single section, devoid of any perforations and the customer gets no receipt other than a copy of his credit card slip or (if he requests it) a hand written slip or machine printed cash register tape.

A further disadvantage of present restaurant checks is that they are flat, and presented face up, so that others at the table besides the payer may read the total amount.

An object of this invention is to provide a check for goods or services in which purchases in different categories (food and liquor, for example) are printed in different portions of the check which are separated by perforations.

It is another object of this invention to provide a guest check which can be sectioned into several parts to serve as receipts for different services.

Another object of this invention is to provide a guest check on which all food purchases are listed on one portion of the check, all alcoholic beverage purchases are listed on another portion of the check, and the grand total on a third portion of the check which is capable of serving as a customer receipt.

Another object of this invention is to provide a guest check in which each of the several portions can be sequentially numbered for future receipt retrieval.

It is yet another object of the invention to provide a guest check that is foldable for attractive appearance and discreet presentation to the customer.

Still another object of this invention is to provide a guest check which can be fed through and printed by a standard tractor feed computer printer.

According to one aspect of this invention there is provided a multiple portion check for goods or services (e.g. a restaurant guest check) comprising:

(a) perforations dividing said check into at least three (3) portions, including a first section for containing a first set of printed indicia (e.g., a list of items purchased in a first category such as food), a second portion for containing a second set of printed indicia (e.g., a list of items purchased in a second category such as alcoholic beverages), and a third portion for listing the total price of all items purchased;

(b) at least one of the first two portions containing printed indicia listing the items purchased in one category;

(c) the third portion containing printed indicia giving the total price of all items purchased.

According to another aspect of this invention there is provided a long continuous multiple section paper sheet comprising a plurality of blank checks for goods or services, said sheet being divided into a plurality of blank checks by transversely extending linear weakened portions, each of said blank checks having perforations dividing said check into at least three portions, including a first portion for containing a first set of printed indicia, a second portion for containing a second set of printed indicia and a third portion for listing the total price of all items purchased. The preferred sheet is a tractor feed sheet which is accordion folded along the transversely extending weakened portions and which includes a tractor feed strip along at least one lateral edge.

BEST MODE FOR CARRYING OUT INVENTION

Figure 1:
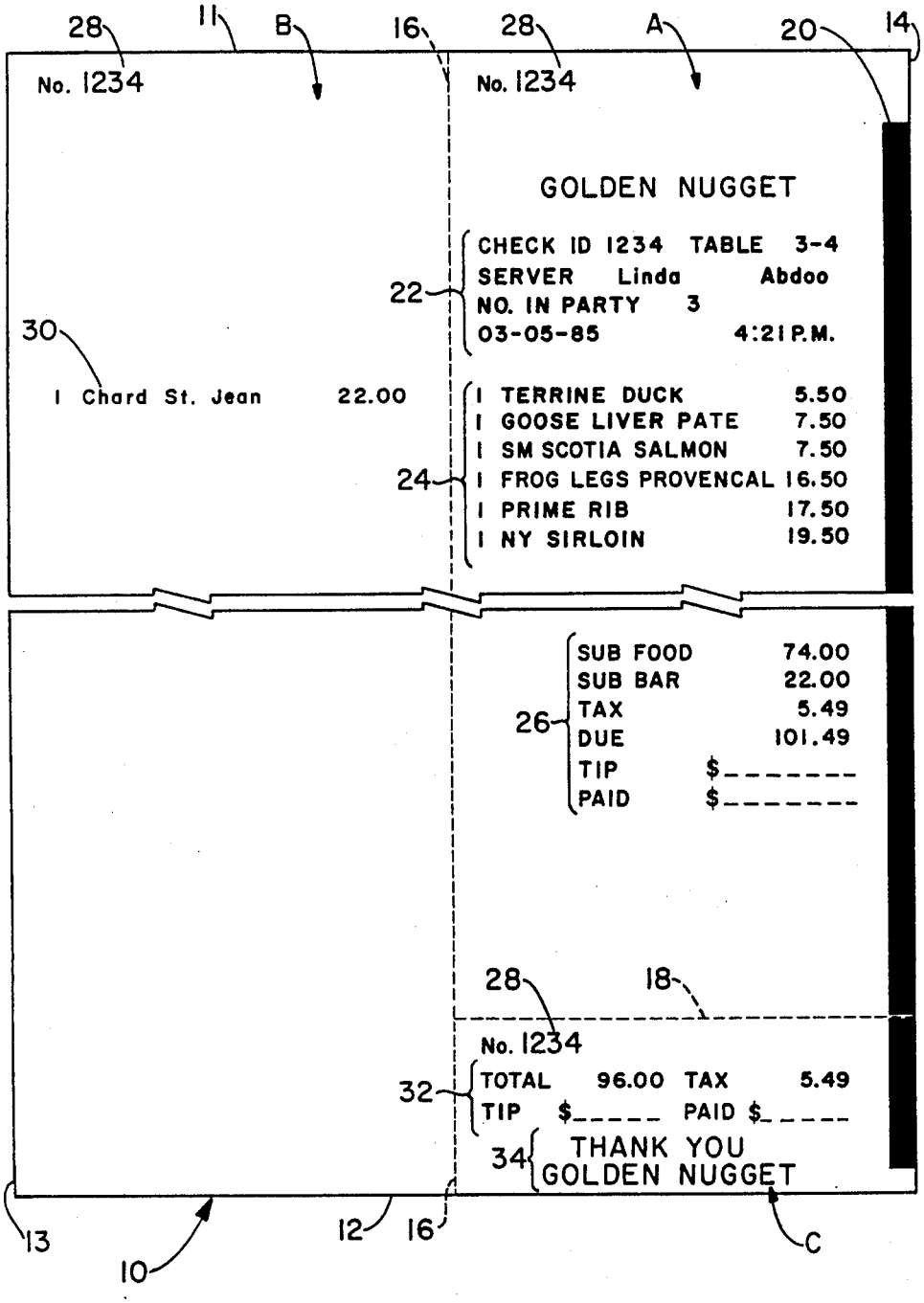
FIG. 1 is a front view of an open, unfolded guest check according to this invention.

FIG. 1 shows the face of a guest check according to this invention when it is open and unfolded. Referring to FIG. 1, 10 is a guest check having top edge 11, bottom edge 12, left edge 13 and right edge 14. Guest check 10 is a rectangular paper sheet which is typically slightly higher than it is wide. Guest check 10 has a vertical (or longitudinally extending) dotted line perforation 16 which extends from top 11 to bottom 12, and a horizontal (or transversely extending) dotted line perforation 18 which extends from the right edge 14 to the vertical perforation 16. Horizontal perforation 18 may extend from either lateral edge, i.e. either the left edge or the right edge, to vertical perforation 16, as desired. These perforations divide guest check 10 into three portions, i.e., a first portion A which is the upper right portion of the guest check, a second portion B which is the left hand portion of the guest check, and a third portion C which is in the lower right hand portion of the guest check. Vertical perforation 16 divides first portion A from second portion B along the greater part of the length thereof. Vertical perforation 16 is preferably slightly to the left of the vertical center line of the guest check 10, so that a narrow strip of the face of guest check 10 along right edge 14 thereof will be visible when the guest check is folded along vertical perforation 16. More will be said about this in the description with respect to FIG. 3. The horizontal perforation 18 is just a short distance above the bottom edge 12 so that third portion C is the smallest of the three portions and typically is much smaller than either of the other two. Portion C serves as a customer receipt on which the grand total price is printed, as will be explained further.

A preprinted decorator strip 20 may be printed along the right edge 14 of the face of the guest check 10 in order to give the guest check a more pleasing appearance when the check is folded. This strip, which appears black in the accompanying drawing, may be an attractive color such as gold or silver on an actual check.

The computer printed indicia on the face of the check 10 will now be described.

The first portion A of the check 10 may include identifying data 22, such as the name of the restaurant, the check identification number (or check I.D.), the table number, the name of the server, the date, and the time at which the customer was (or customers were) seated. These data are printed in the upper part of portion A. Below the identifying data 22 is an itemized list 24 of each food item purchased, the quantity thereof and the price thereof. In the illustration only one portion of each item was purchased. Now suppose that two portions of prime rib had been purchased. Then the line reading "One prime rib . . . 17.50" would read "Two prime rib . . . 35.00".

Below the itemized list 24 of food items is a summary total 26 of all items purchased. This summary total 26 includes a sub-total of food items, a sub-total of bar or alcoholic beverage items, sales tax (where applicable), and the total amount due. This summary total may be printed in either portion A or portion B, as desired by the business establishment, but it should appear in at least one of these two portions. Additional blank lines may be provided for a tip and a indication of the total amount paid; these last two lines are filled in by the customer.

The check identification number may be repeated as a separate item 28 near the top of portion A and given near the tops of portions B and C, as shown. It is highly desirable to print the check number on each portion.

The second portion B has an itemized list 30 of all bar or alcoholic beverage purchases. One such item, i.e. a bottle of wine, is given in the illustration in FIG. 1. Where more than one alcoholic beverage item is purchased, each such item is listed in portion B and a sub-total of all alcoholic beverage purchases may also be given in this portion of the check.

The third portion C of the check has a bottom line summary 32 which includes the total price of food and alcoholic beverages items purchased, and the tax (where applicable), and may include blank lines, to be filled in by the customer, for the amount of the tip and the total amount paid. Below this bottom line summary 32 may be a courtesy message 34 which may include, for example, "Thank You" and the name of the restaurant.

All the items denoted by reference numerals 22 through 34 are printed by computer on the face of check 10 when the guest asks for his check. Items are printed in two columns, i.e. a left hand column (portion B) and a right hand column (portions A and C). All data are entered as they are ascertained and stored in the computer memory until printed out. Thus, the identifying data 22 are entered when the person or party is seated. Individual food items and bar items are entered as these items are purchased. When the customer asks for his check, all items are printed out as shown. Thus, an itemized list of food items 24 is printed out in portion A of check 10 and an itemized list of bar items 30 is printed out in portion B. The computer also generates sub-totals of food items and bar items, calculates the amount of tax and a total amount due and prints out this information as a summary total (or a summary of purchases) 26 in portion A. The computer also prints out the bottom line summary 32 and courtesy message 34 in portion C.

The computer may be any general purpose computer having a printer and tractor feeder associated therewith. Such computers are well known in the art. The computer program must be capable of storing individual items of data as they are entered, must be able to add food items and alcoholic beverage items separately so as to obtain separate sub-totals for each, to add the sub-totals to arrive at a grand total, to calculate the appropriate tax, and to print out itemized food and bar lists in separate portions of the check, as shown in FIG. 1. Provision of an appropriate computer program is within the ordinary skill of the art.

Figure 2:
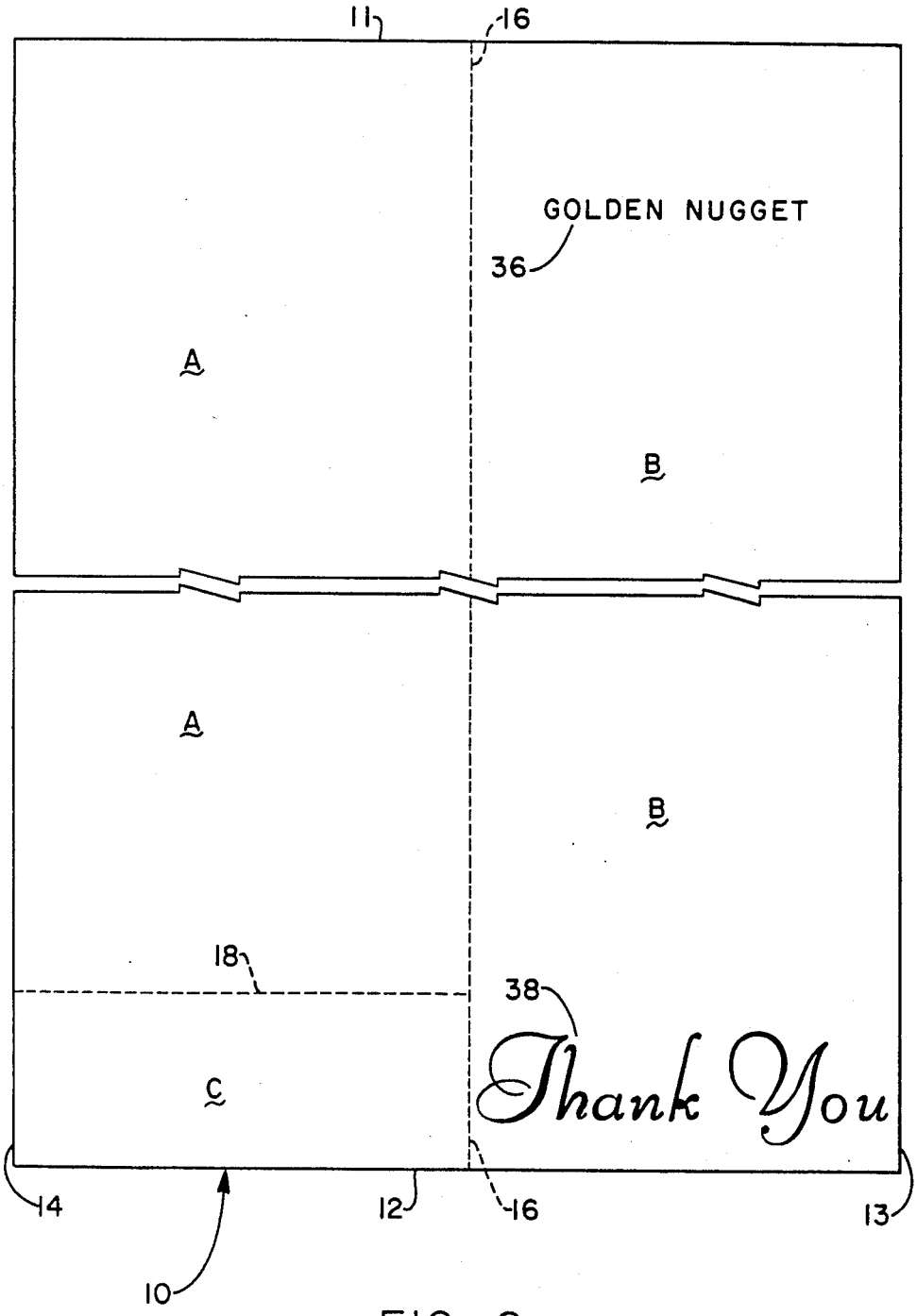
FIG. 2 is a back view of an open, unfolded guest check according to this invention.

The back of guest check 10 is shown in FIG. 2. As shown in FIG. 2, portions A and C are on the left hand side of guest check 10 as it appears from the back, and portion A is on the right hand side. The positions of edges 13 and 14 are reversed; 14 is the left hand edge and 13 the right edge as seen from the back. Horizontal perforation 18 extends from the left edge 14 to the vertical perforation 16, as seen in this view.

The back of guest check 10 contains no computer printed matter. However, it may contain preprinted matter, such as the restaurant logo 36 and a courtesy message 38 such as "Thank You". These preprinted items 36 and 38, like preprinted decorator stripe 20 on the face of the guest check 10, are printed on the guest check by conventional methods before it is fed to the computer.

Figure 3:
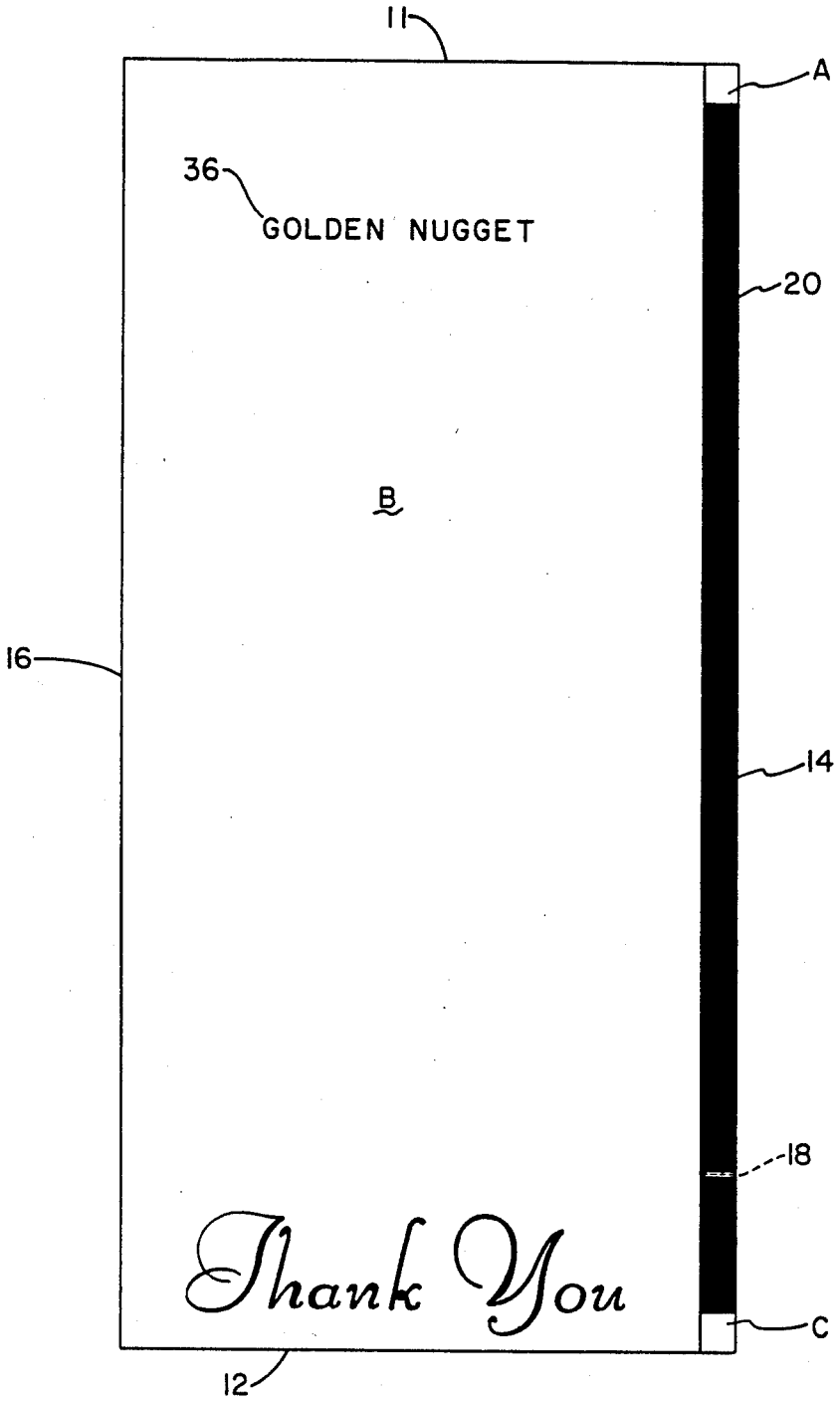
FIG. 3 is a front view of a closed, folded guest check according to this invention.

Guest check 10 is preferably folded along vertical perforation 16, as shown in FIG. 3 before it is presented to the customer. When folded the back of portion B with restaurant logo 36 and courtesy message 38 form the front cover of the check. All printed indicis shown in FIG. 1 are hidden. The entire face of the check is obscured except for a small strip along the right edge 14 thereof. The visible strip includes the preprinted decorator stripe 20 and a small portion of horizontal perforation 18. The width of decorator stripe 20 is preferably equal to the width of the visible strip. The folded check makes an attractive display for the customer, in contract to the rather unattractive appearance of the conventional guest check which is presented flat. Also, only the person paying the check (the payer) sees either the itemized lists of purchases or the total. In contrast, when a conventional restaurant check with a hand written total is presented, others in the party can read the total.

Suppose now that no one in a given party orders any alcoholic beverages. Referring to FIG. 1, portion B will be blank, and there will be no listing for bar purchases in the summary of purchases 26 in portion A. Similarly, suppose a bar patron orders no food. His liquor purchases will be itemized and sub-totalled in portion B, and the sub-total, any applicable tax (if not included in the purchase price) and the total amount due will appear in the summary of purchases 26 of portion A. The itemized list of food items 24 will be missing, if no food purchases were made. Thus, it is possible that only one portion of the check will contain any printed indicia listing items purchased.

The arrangement of perforations and the arrangement and content of printed matter will vary depending on the situation. For example, suppose a restaurant operates a gift shop and the restaurant management wishes to provide a single check which includes gift shop purchases as well as food and alcoholic beverage purchases. In that case, a guest check divided by perforations into four portions is required. Where n is the number of categories of purchases to be shown on the guest check, the number of portions required is $n+1$. The minimum value of n in guest checks according to this invention is 2.

Other variations in content and arrangement are possible. For example, the check may have four portions separated by perforations, the fourth portion containing promotional material such as a discount coupon for future use at the same or a different business establishment. The first three portions may have the same contents as in the preferred embodiment.

Figure 4:
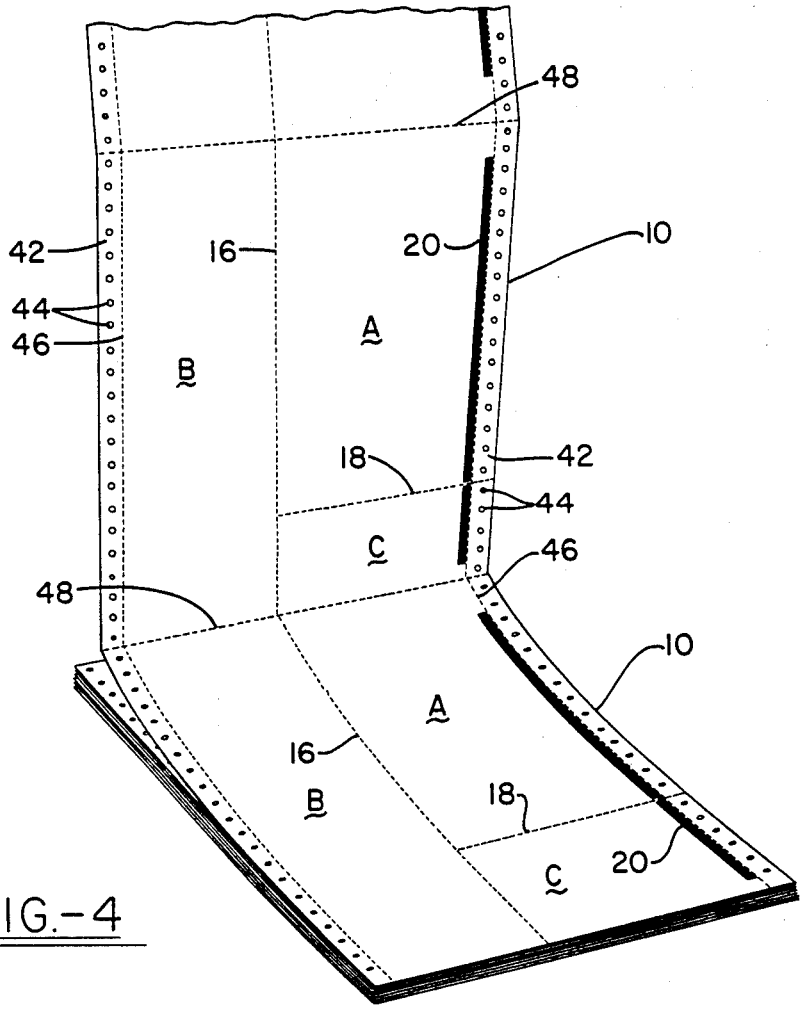
FIG. 4 is a front view of a portion of a tractor feed sheet according to this invention.

FIG. 4 illustrates a tractor feed sheet 40 according to this invention. Referring now to FIG. 4, tractor feed sheet 40 is a long continuous multiple section paper sheet which comprises a plurality of blank checks 10 arranged end to end in the same orientation, and tractor feed strips 42 on either side of the sheet 10. Each of the tractor feed strips contains a plurality of evenly spaced holes. Longitudinally extending linear weakened portions 46, which extend the entire length of sheet 40, separate the tractor feed strips 42 from the center or main portion of the sheet 40 which contains the blank guest checks 10. Tractor feed sheet 40 also has a plurality of evenly spaced transversely extending weakened portions 48, which extend across the linear width of sheet 10 and which divides the continuous sheet 40 into a plurality of blank checks 10. Each of the transversely extending weakened portions 48 constitutes the lower edge of one guest check 10 and the upper edge of the adjacent check. The checks are preprinted with the decorator stripe 20, the restaurant logo 36 and the courtesy message 38 as previously explained.

The tractor feed paper 40 is accordion folded along the transversely extending weakened portions 48, and is fed to the printer in the conventional manner. Any printer capable of handling tractor feed paper and being controlled by a computer may be used.

In operation, the identifying data 22 (FIG. 1) are entered into the computer memory when a new party is seated at its table. Food and alcoholic beverage purchases are entered into the computer memory as they are made. When the payer requests the check, the printer prints out all data denoted by reference numerals 22 through 34, inclusive (shown in FIG. 1) on the face of the first blank check 10 on tractor feed sheet 40. Tractor feed sheet 40 is accordion folded and stored on a suitable stand and is fed face down to the printer in the usual manner. When a check has been printed out, the printer advances the tractor feed sheet so that printed check 10 is ejected from the printer and the next blank check is ready for printing. The waiter or waitress tears off the check, folds it along vertical perforation 16, and presents it to the payer.

A second (and even a third) copy for restaurant use may be printed if desired. The establishment copy would be printed immediately after the customer copy or the next individual sheet 10 of tractor feed sheet 40. It is ordinarily preferred not to print an establishment copy. All of the information contained on each guest check is contained in the computer memory where it may be retreived and processed as needed.

The guest check of this invention offers a number of advantages over restaurant guest checks currently in use. First of all, it is entirely printed with no hand written entries whatever other than customer's entries to indicate the amount of the tip and the total amount paid. This reduces the chances for mathematical error. Also, this check is much neater looking than a check which is entirely or partially hand written. Second, the check is printed out in an easy-to-read format which is convenient for both the customer and for the restaurant when checking sales against inventory and cash receipts. Third, a guest check according to this invention can be printed more quickly than a single section check containing the same information. The check of this invention, by virtue of its two-column format, requires fewer lines. By way of illustration, it will be noted in FIG. 1 that "1 Chard St. Jean" in portion B (left hand column) and "1 Terrine Duck" in portion A (right hand column) are on the same line, and the latter would be printed immediately after the former in a single line sweep of the printer. These entries would be printed on separate lines in a single column, requiring more printing time, in a single section check.

A further advantage is that the perforations in the customer's copy make it easy for the customer to detach certain portions of the check from the remainder. This is particularly handy when the customer is traveling on an expense account where food but not liquor purchases will be reimbursed. In that case he can present portions A and C of the check to appropriate company personnel for expense account reimbursement while retaining or discarding portion B. He may present only portion C if the employer requires only a receipt for the grand total. Similarly, the restaurant copy may be partitioned if desired so the different persons within the restaurant can check the food portions and the beverage portions of checks against inventory and cash receipts.

Another advantage is that the check can be quickly, efficiently and accurately printed out on a standard tractor feed computer printer. A further advantage is that the tractor feed strips can be quickly and easily torn off to provided attractive edges. A further advantage is that the printed check may be discreetly presented so that no one except the payer sees the figures. A still further advantage is that the check when folded for presentation to the payer makes a pleasing appearance. A still further advantage is that each portion of each check can be sequentially numbered for future receipt retrieval.

It will be apparent that a check of the type described can be used in business establishments other than restaurants. For example, a hotel check having different portions for room, food, and telephone and miscellaneous charges may be prepared according to this invention. Such a check would provide the hotel guest with separate sub-totals showing total room charges, total food purchases, etc. This would save the hotel guest or his employer's accounting department the necessity of adding the daily figures in order to obtain totals for expense account purposes. Also, in certain categories of expense, for example telephone calls where no business purpose is shown (telephone calls to one's family for example), the hotel guest would detach this portion of the check from the remainder before presentation to his employer for expense account reimbursement. The guest check of this invention would also be convenient for the hotel, as it could route different portions to different units within the hotel (the food portion would go to the dining room, for example) for accounting.

A check according to this invention would also be very useful for auto repair shops since the customer would have a neatly printed record on both parts and labor charges, and the auto repair shop would have a copy with perforations according to this invention, enabling it to route the portion with parts itemization to the Parts Department for inventory control purposes while the remainder of the bill is routed to someone else for accounting purposes.

Still other types of business establishments can use a check according to this invention. For example, suppose that a customer of a home and garden supply store purchases paint, roses and lumber in three separate departments, and that the latter two are picked up by the customer in his car (or other vehicle) at a pick-up station. Each department would ring up its sales separately, all using the same check number, which would be assigned when the first sale is rung up. As the customer leaves the store, he would obtain a printed receipt in a form similar to that shown in FIG. 1, with purchases in the customer's hand (e.g. paint) listed on one portion (e.g. portion A) purchases to be picked up at the pick-up station, (e.g., roses and lumber) listed in a second portion (e.g. portion B), and the grand total given in a third portion (e.g., portion C). The customer would then surrender the second portion at the pick-up station when he obtains his pick-up purchases. Alternatively, the computer could be programmed to print out two copies of the pick-up purchases only, so that both the customer and the pick-up station would have copies.

While in accordance with the patent statutes, a preferred embodiment and best mode has been presented, the scope of the invention is not limited thereto, but rather is measured by the scope of the attached claims.

What is claimed is:

1. A multiple portion check for goods or services comprising:

(a) perforation means dividing said check into at least three portions, said perforation means including a longitudinal perforation near the longitudinal centerline of the check for dividing a first portion from a second portion, and a transverse perforation dividing a third portion from at least one of the first two portions, said transverse perforation being close to the bottom edge of the check and intersecting said longitudinal portion.

(b) said first portion being adapted to contain a first set of computer printed indicia listing the items purchased in a first category and the price thereof, said second portion being adapted to contain a second set of computer printed indicia, different from said first set, listing the items purchased in a second category and the price thereof;

(c) at least one of the first two portions containing the aforesaid printed indicia (d) the third portion containing computer printed indicia giving the total price of all items purchased.

2. A check according to claim 1 in which said longitudinally extending perforation extends the entire length of the check and said transversely extending perforation extends from one lateral edge to said longitudinally extending perforation.

3. A check according to claim 1 in which the third portion is the smallest portion in said check.

4. A check according to claim 1 in which the third portion is a customer receipt.

5. A check according to claim 1 in which said first portion contains a listing of the items purchased in said first category and the price thereof, and said second portion contains a listing of the items purchased in said second cateogory and the price thereof.

6. A check according to claim 5, said check being a restaurant guest check in which said first category is food , and said second category is alcoholic beverages 7. A check according to claim 6 in which said first portion also contains the total price of all items purchased.

8. A check according to claim 1 in which the check is numbered and the same check number is printed on all portions.

9. A check according to claim 1 in which said check has a face and a back and all of the computer printed indicia appearing on the check are printed on the face thereof.

10. A check according to claim 9 in which said longitudinally extending perforation is located slightly to the left of the center line of said check 11. A check according to claim 10 including a preprinted decorator strip along the right edge of the face thereof.

12. A check according to claim 9 including preprinted information identifying the business establishment on the back of the check.

13. A check according to claim 1 in which said longitudinally extending perforation is the only longitudinally extending perforation in said check.

14. A long continuous paper sheet comprising a plurality of blank checks for goods or services, said sheet being divided into said plurality of blank checks by transversely extending score lines, each of said checks including perforation means dividing said check into at least three portions, including a first portion for containing a first set of printed indicia, a second portion for containing a second set of printed indicia, and a third portion for listing the total price of all items purchased, said perforation means including a single longitudinally extending parforation near the longitudinal center line of the check for dividing said first portion from said second portion, and a transversely extending perforation dividing said third portion from at least one of said first and second portions, said transversely extending perforation being close to the bottom edge of the check and intersecting said longitudinally extending perforation, whereby said third portion extends transversely along the bottom edge of each check and is smaller than either said first or said second portion.

15. A sheet according to claim 14 which is accordion folded along said transversely extending score lines.

16. a sheet according to claim 14, said sheet being a tractor feed sheet including a tractor feed strip along at least one lateral edge thereof, and a longitudinally extending score line separating said tractor feed strip from said checks.

17. A sheet according to claim 14 in which said perforation means include a longitudinally extending perforation located slightly to the left of the center line of said sheet.

* * * * *